US007387228B2

(12) United States Patent
Yeh et al.

(10) Patent No.: US 7,387,228 B2
(45) Date of Patent: Jun. 17, 2008

(54) MAGAZINE WITH POSITIONING DEVICE FOR NAIL GUN

(75) Inventors: Tung-Sung Yeh, Tali (TW); Yu-Chuan Ho, Tali (TW)

(73) Assignee: Apach Industrial Co., Ltd., Taichung County (TW)

( * ) Notice: Subject to any disclaimer, the term of this patent is extended or adjusted under 35 U.S.C. 154(b) by 16 days.

(21) Appl. No.: 11/603,025

(22) Filed: Nov. 22, 2006

(65) Prior Publication Data

US 2008/0116242 A1 May 22, 2008

(51) Int. Cl.
*B25C 1/04* (2006.01)

(52) U.S. Cl. ..... 227/120; 227/136; 227/109

(58) Field of Classification Search ..... 227/120, 227/136, 109

See application file for complete search history.

(56) References Cited

U.S. PATENT DOCUMENTS 3,099,012 A * 7/1963 Wandel ..... 227/123
4,389,012 A * 6/1983 Grikis et al. ..... 227/120
5,816,469 A * 10/1998 Ohuchi ..... 227/119
5,975,350 A * 11/1999 Han ..... 221/232
6,053,389 A * 4/2000 Chu et al. ..... 227/120
6,085,959 A * 7/2000 Lee ..... 227/120
6,296,167 B1 * 10/2001 Jen ..... 227/120
6,431,428 B1 * 8/2002 Chen ..... 227/120
6,592,016 B2 * 7/2003 Hamano et al. ..... 227/119
6,772,931 B2 * 8/2004 Miller et al. ..... 227/120

* cited by examiner

*Primary Examiner*—Rinaldi I. Rada
*Assistant Examiner*—Michelle Lopez
(74) *Attorney, Agent, or Firm*—Banger Shia

(57) ABSTRACT

A magazine with a positioning device for a nail gun includes a magazine that has a nail loading port on one end thereof, and a gliding part that has a protruding part and a locking part. The magazine has fixing parts, penetrating parts and a stopping part. The gliding device has a nail storing part and is inserted into the receiving chamber. The gliding device is fixed by a positioning device, so that the gliding device will not depart from the magazine due to the bounce motion while nailing, and the protruding part and the locking part of the gliding device are not easy to get abrasion. The objectives of providing the operator a safe and secured working environment, prolonging the lifetime of the gliding device and securing the gliding device in position will be attained.

4 Claims, 5 Drawing Sheets

MAGAZINE WITH POSITIONING DEVICE FOR NAIL GUN

FIELD OF THE INVENTION

The present invention generally relates to the field of nail guns, and more particularly to a magazine with a positioning device for use with nail guns. The magazine comprises a nail loading port for installing a gliding device that is fixed by a positioning device so that the gliding device will not bounce out to cause the safety problems of departing or incomplete positioning while nailing, that relatively minimize the abrasion of the protruding part and locking part on one end of the gliding device. The objectives of providing the operator a safe and secured working environment, prolonging the lifetime of the gliding device and securing the gliding device in position will be attained.

BACKGROUND OF THE INVENTION

When a conventional nail gun is on the process of nailing, the nail chamber inside the magazine for gliding nails is rubbed against the nails frequently to cause abrasion on the inner of the nail chamber, and the nails are easy to get stuck because the space inside the nail chamber is too big. The operator is unable to carry on the nailing operation and replacement or maintenance is required, therefore improvement is necessary.

An improvement on relevant mechanism such as TW Appl. No. 083214748, which disclosed that the mechanism consisted of gliding block, connecting plate, fixing base, guiding plate and adjusting plate. The gliding block penetrates the fixing base and two corresponding guiding plates and keeps a proper distance inside the magazine cover, and the adjusting plate is arranged between two guiding plates, in addition, one end of the connecting plate is coupled to the notch of the adjusting plate. However, the inner portion of the magazine for gliding the nail has no protective structure, therefore improvement is necessary.

There is another improvement on relevant mechanism as shown in FIG. 5, which disclosed that a magazine includes a gliding device, via the gliding device to protect the inner portion of the magazine for gliding the nails. One end of the gliding device has a protruding part and a locking part for fixing with the magazine, and the magazine has an aperture of retaining part relative to the protruding part for fixing with the gliding device to reduce the abrasion on the inner wall of the magazine and avoid slant of nails. In addition, the gliding device may be replaceable.

Although the above-mentioned structures can achieve the objective of improvement on magazine, however such structures still have shortcomings in use, such as the protruding part and locking part of the gliding device are easy to get abrasion and unable to be fixed. The foregoing structure discloses that the gliding device is able to reduce the abrasion on the inner wall of the magazine and replaceable, but the protruding part and locking part of the gliding device will bear a reacting force while nailing, which will cause the gliding device to bounce. The protruding part only has one fixed point, which is unable to contact tightly with the magazine, so that the protruding part, the locking part and the retaining part will be attrited, and the gliding device is easy to come off the magazine so that the nails are unable to push to the barrel smoothly.

In addition, the inner wall of the magazine is easy to be attrited. Because the gliding device is not fixed exactly, after the protruding part, the locking part and the retaining part are attrited, the gliding device is easy to get loose. Besides, the nail heads are glided inside the gliding device and the rest portions of the nails are accommodated inside the magazine, which will cause an improper shake. The inner wall of the magazine is easy to rub with the nails while nailing, which will cause the abrasion on the inner wall. After a period of use time, the inner space will be enlarged and the nails will be easy to get stuck.

SUMMARY OF THE INVENTION

The objective of the present invention is to provide a magazine with a positioning device that is simplified and economical to manufacture.

The other objective of the present invention is to provide a magazine with a positioning device for use with nail guns. The magazine comprises a nail loading port for loading nails on one end thereof, and a long groove of receiving chamber for accommodating a gliding device on the other end. The receiving chamber includes a retaining part and a stopping part on one end, and two penetrating parts and fixing parts are provided near the retaining part. The gliding device essentially has a gliding body that includes a protruding part and a locking part, the protruding part and locking part are engaged with the retaining part and stopping part of the magazine. The gliding device is fixed on the magazine via the buckling parts and puncturing parts of the positioning device engaging with the fixing part and penetrating part, so that the gliding device will not depart from the magazine due to the bounce motion while nailing, and the protruding part and the locking part of the gliding device are not easy to get abrasion. The objectives of providing the operator a safe and secured working environment, prolonging the lifetime of the gliding device and securing the gliding device in position will be attained.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
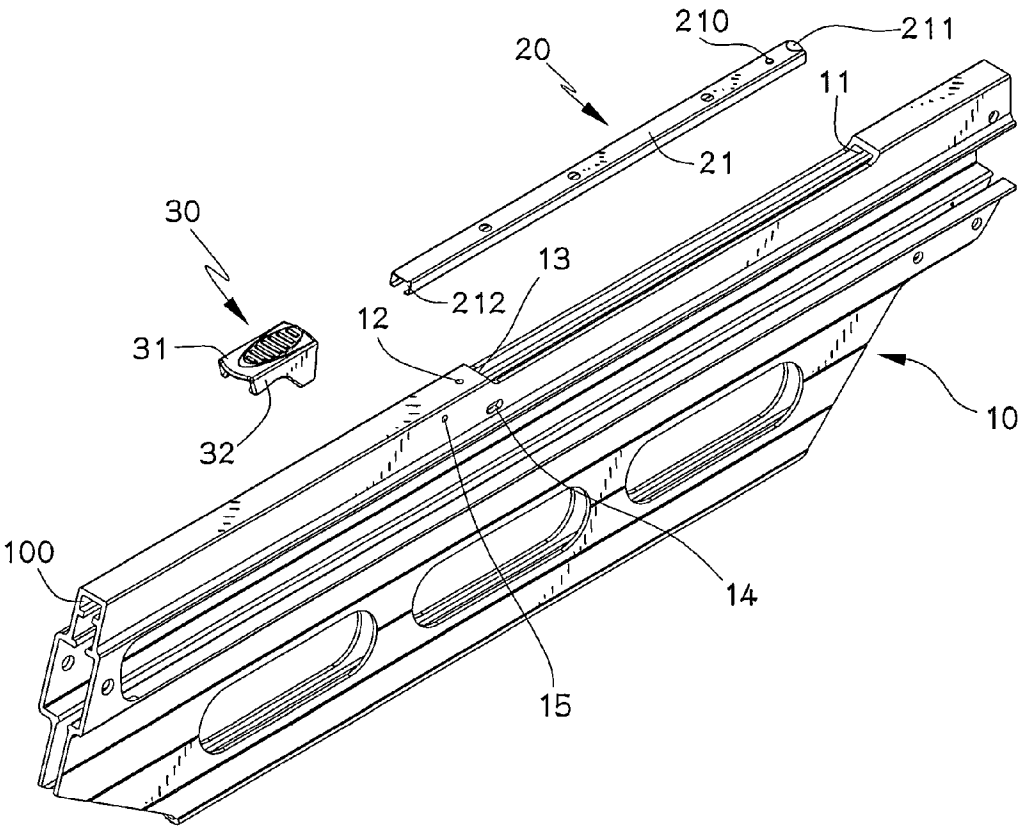
FIG. 1 is an exploded view of the of the present invention.

Referring to FIGS. 1 to 4, a magazine with a positioning device for a nail gun is shown. The magazine 10 accommodates a gliding device 20, which is installed inside the magazine 10 and blocked by a positioning device 30.

The magazine 10 includes an elongated groove of nail loading port 11 on one end thereof, and a receiving chamber 100 for accommodating the nail heads on the other end, wherein a gliding device 20 is installed inside the receiving chamber 100. The receiving chamber 100 includes a round hole of retaining part 12, a cascade of stopping part 13 formed on the end near the nail loading port 11, two oval-shaped slots of penetrating parts 14 provided on two sides of the retaining part 12, and two round hole of fixing parts 15 provided near the penetrating parts 14.

The gliding device 20 essentially has an elongated inverted-U shape of gliding body 21 that includes a boss of protruding part 210 relative to the aforesaid retaining part 12, a protrudent quarter sphere of locking part 211 relative to the stopping part 13, and a hollow nail storing part 212 provided inside the gliding body 21 for storing nail heads. The gliding device 20 may be made by wear-resisting material, such as metal or other hard material.

Figure 2:
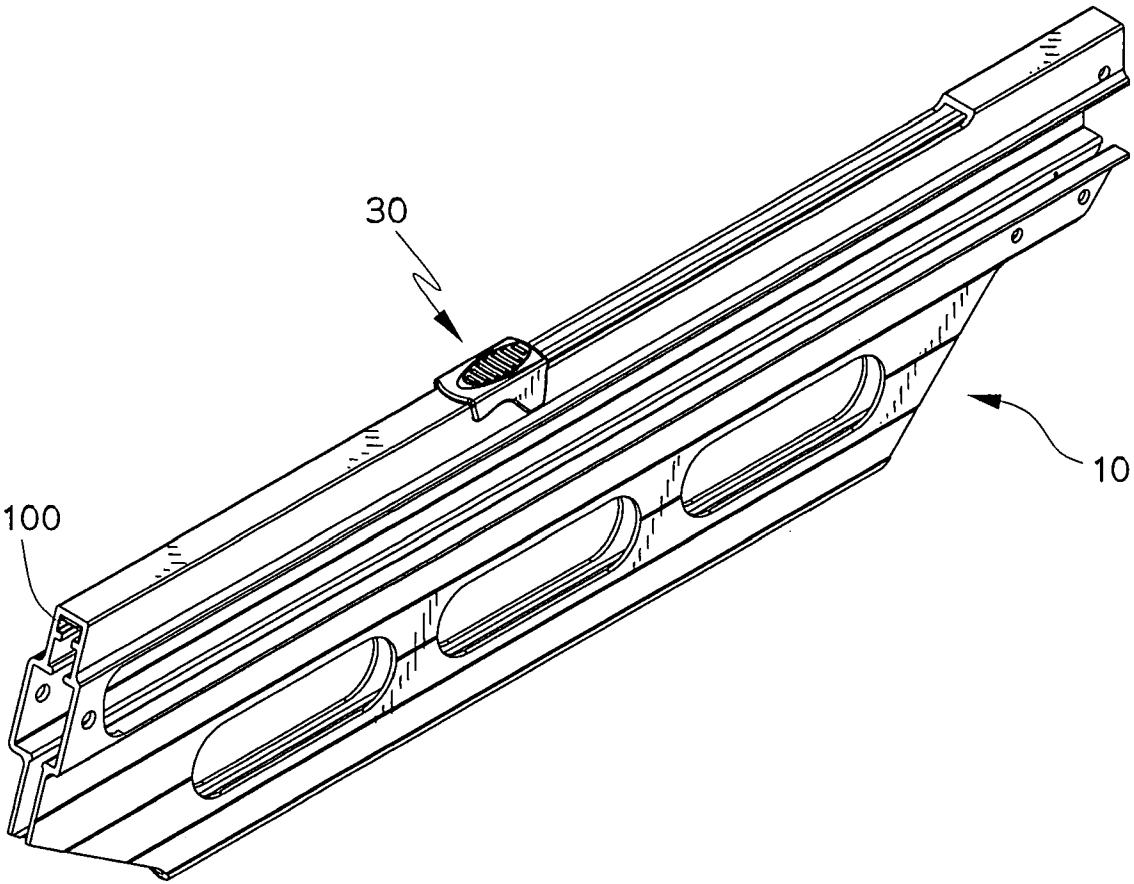
FIG. 2 is a perspective view of the of the present invention.
Figure 3:
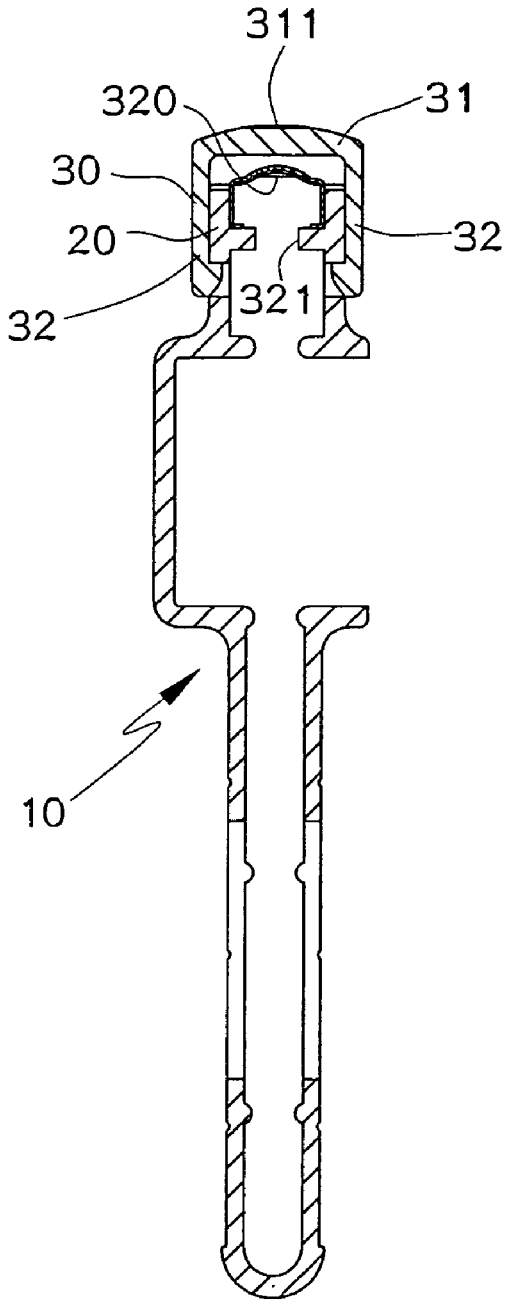
FIG. 3 is a partial cross-sectional view of the present invention.
Figure 4:
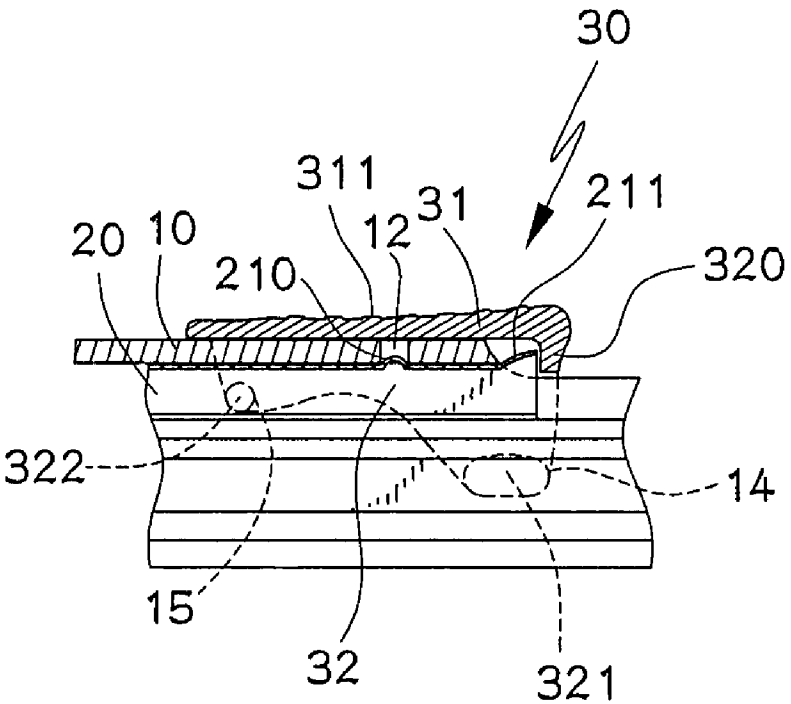
FIG. 4 is a partial side view of the present invention.
Figure 5:
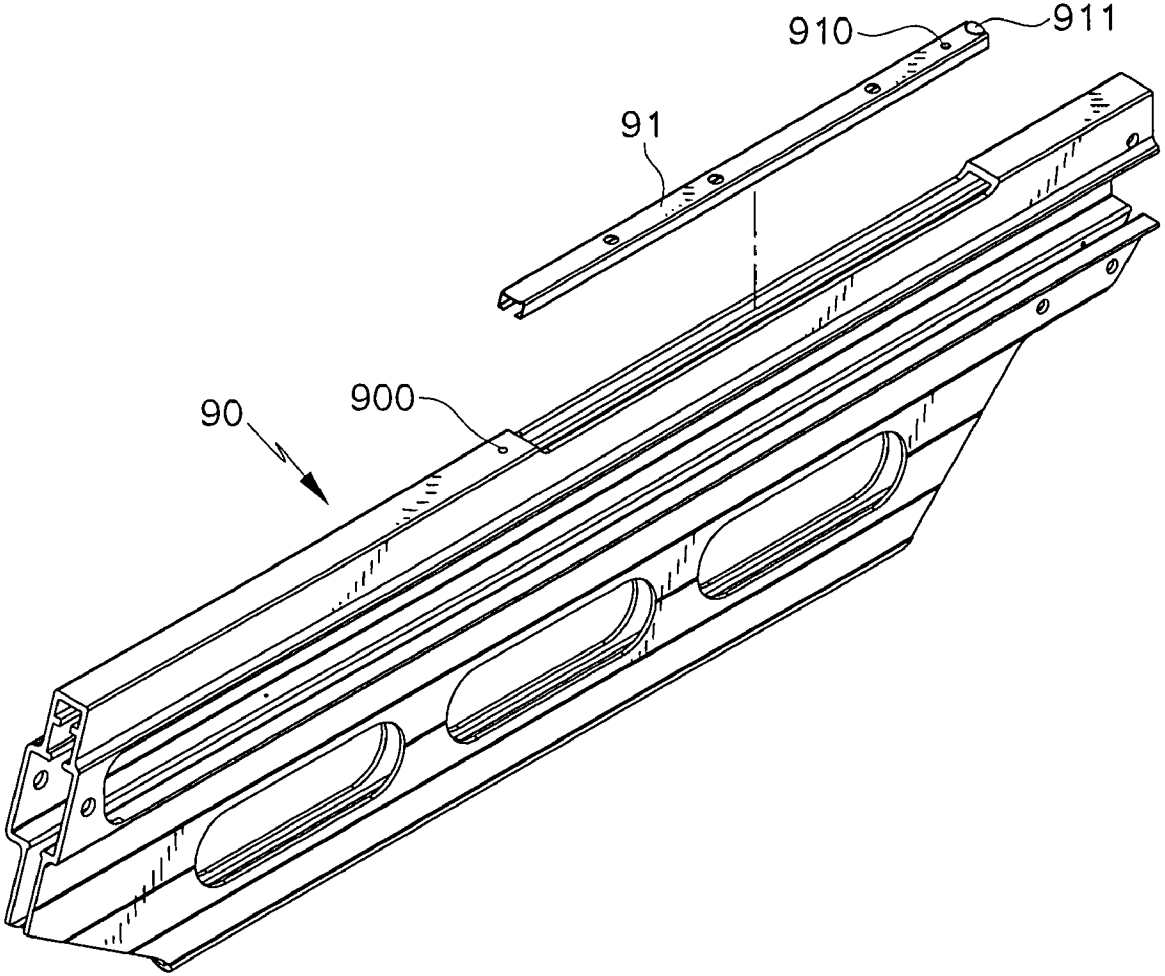
FIG. 5 is an exploded view of the prior art.

The positioning device 30 is made by plastic and formed in one piece, the whole structure may be made by a hard material with elasticity or a soft material that can lock on the magazine 10. The positioning device 30 includes an inverted-U shape of positioning member 31 that has a pushing part 311 with transverse stripes on the top thereof and two opposite fastening parts 32 on both sides thereof relative to the magazine 10. A flat plate of blocking part 320 is disposed between two fastening parts 32 relative to the locking part 211 of the gliding device 20 to block the gliding device 20 from withdrawing from the receiving chamber 100. Each of the fastening parts 32 has an oval-shaped protrusion of puncturing part 321 and a boss of buckling part 322 relative to the penetrating part 14 and fixing part 15 of the magazine 10.

Wherein the gliding device 20 is inserted into the receiving chamber 100 from the nail loading port 11 of the magazine 10. Referring to FIGS. 2 to 4, the locking part 211 of the gliding device 20 is locked with the stopping part 13 of the magazine 10, and the protruding part 210 of the gliding device 20 is engaged with the retaining part 12 of the magazine 10. After the gliding device 20 is inserted into the receiving chamber 100 of the magazine 10, by the blocking part 320 of the positioning device 30 blocking the locking part 211 of the gliding device 20, the puncturing parts 321 of the fastening parts 32 puncturing the two penetrating parts 14, and the buckling parts 322 of the fastening parts 32 fixing with the fixing parts 15 of the magazine 10, the positioning device 30 is engaged with the gliding device 20 tightly to prevent the bounce motion.

While we have shown and described the embodiment in accordance with the present invention, it should be clear to those skilled in the art that further embodiments may be made without departing from the scope of the present invention.

What is claimed is:

1. A magazine with a positioning device for a nail gun comprising:

a magazine including a nail loading port and a receiving chamber accommodating a gliding device, said receiving chamber having at least one retaining part relative to said gliding device and at least one pair of penetrating parts on both sides relative to a positioning device;

said gliding device including a gliding body inserted into said receiving chamber, a protruding part relative to said retaining part and a nail storing part disposed therein; and said positioning device including a blocking part provided on the end of said positioning device relative to one end of said gliding device and a puncturing part relative to said penetrating part;

wherein said positioning device is fixed to said magazine quickly via said puncturing part engaging elastically with said penetrating part, and uses said blocking part to block said gliding device;

wherein said magazine has at least one pair of said penetrating parts and fixing parts on two sides thereof relative to said positioning device that has said puncturing part and buckling parts.

2. The magazine with a positioning device for a nail gun as claimed in claim 1, wherein said magazine includes said nail loading port and said receiving chamber that accommodates said gliding device, said receiving chamber having at least one stopping part and at least one said retaining part relative to said gliding device, said gliding device having a locking part and said protruding part.

3. The magazine with a positioning device for a nail gun as claimed in claim 1, wherein said positioning device may be made by soft material or hard material, said positioning device including a positioning member with a pushing part on top thereof, fastening parts extended from two sides of said positioning device to said magazine and said blocking part disposed between said fastening parts to block said gliding device, said fastening parts having said puncturing parts and buckling parts.

4. The magazine with a positioning device for a nail gun as claimed in claim 1, wherein said gliding device is in form of an elongated inverted-U shape.

* * * * *